US005568015A

United States Patent [19]

Holber et al.

[11] Patent Number: 5,568,015

[45] Date of Patent: Oct. 22, 1996

[54] FLUID-COOLED DIELECTRIC WINDOW FOR A PLASMA SYSTEM

[75] Inventors: William M. Holber, Cambridge; Donald K. Smith, Belmont; Matthew M. Besen, Tewksbury, all of Mass.; Matthew P. Fitzner, Nashua, N.H.; Eric J. Georgelis, Canton, Mass.

[73] Assignee: Applied Science and Technology, Inc., Woburn, Mass.

[21] Appl. No.: 389,250

[22] Filed: Feb. 16, 1995

[51] Int. Cl.[6] ..... H01P 1/08; H05H 1/34

[52] U.S. Cl. ..... 315/39; 315/111.21; 333/252; 333/99 PL

[58] Field of Search ..... 333/252, 99 PL; 118/723 MW, 723 AN; 315/111.21, 39

[56] References Cited

U.S. PATENT DOCUMENTS

| | | | |
|---|---|---|---|
| 2,990,526 | 6/1961 | Shelton, Jr. | 333/252 |
| 3,439,296 | 4/1969 | Buckley | 333/252 |
| 5,008,593 | 4/1991 | Schlie et al. | 315/39 |
| 5,051,715 | 9/1991 | Agosti et al. | 333/252 |
| 5,126,635 | 6/1992 | Doehler et al. | 333/252 X |
| 5,235,251 | 8/1993 | Schlie | 315/112 |
| 5,313,179 | 5/1994 | Moeller | 333/252 |

FOREIGN PATENT DOCUMENTS

| | | | |
|---|---|---|---|
| 1259981 | 2/1968 | Germany | 333/252 |
| 64-71097 | 3/1989 | Japan . | |
| 3-127499 | 5/1991 | Japan . | |
| 3-283299 | 12/1991 | Japan . | |

*Primary Examiner*—Benny T. Lee
*Attorney, Agent, or Firm*—Testa, Hurwitz & Thibeault, LLP

[57] ABSTRACT

A fluid-cooled dielectric window for a microwave plasma system which uses microwave absorbing fluids is described. The window includes a dielectric window and a cooling member in contact with an outer surface of the window which defines a channel and a medium adjacent to the channel. The channel transports a microwave absorbing cooling fluid over the outer surface of the window. The medium allows an electric field to enter through the window and sustain a plasma in a chamber while the fluid is flowing through the channel.

19 Claims, 4 Drawing Sheets

FLUID-COOLED DIELECTRIC WINDOW FOR A PLASMA SYSTEM

RELATED APPLICATION

This application is related to commonly assigned copending U.S. Pat. application Ser. No. 08/389,243.

FIELD OF THE INVENTION

The invention relates generally to the field of microwave plasma systems. In particular, the invention relates to a fluid-cooled microwave plasma applicator for producing reactive gaseous species for processing applications.

BACKGROUND OF THE INVENTION

Reactive gases and gas mixtures are used in many industrial operations including the processing of semiconductor wafers for fabricating electronic and optical devices. Reactive gasses can be used, for example, to etch dielectric and semiconductor materials or various masking films such as photoresist and polyimide. In addition, reactive gasses can be used to form dielectric films.

Reactive species of gas molecules can be produced by exciting gas molecules in a plasma discharge. The discharge can be created with a plasma source by coupling energy into a discharge tube or a dielectric window on a chamber containing the gas. Microwave energy is often used as the energy source to create and sustain a plasma discharge. A typical microwave frequency used for creating plasma discharges is 2.45 GHz, due to the availability of power sources and system components.

It is desirable to have a plasma source which is capable of producing a large quantity of various reactive gaseous species under very clean conditions. Examples of desirable species include the various atomic halogens (atomic fluorine, chlorine, bromine, etc.), atomic oxygen, and atomic nitrogen. One technical difficulty in using microwave energy for creating a large quantity of reactive gaseous species in a plasma source is cooling the plasma discharge tube or dielectric window. Air cooling can be used for the discharge tube, but it is relatively inefficient compared with liquid cooling. In addition, air cooling requires relatively large and expensive air blowers or compressors to remove a sufficient amount of heat. Also, air cooling may not be compatible with modern clean room environments used for manufacturing semiconductors.

Liquid cooling is advantageous because it is efficient. Water cooling is particularly desirable because water has good thermal conductivity and it is both safe to handle and environmentally benign. Also, chilled water is readily available in nearly all manufacturing, university and research and development facilities. A barrier to using water for cooling microwave plasma discharge tubes is that water also readily absorbs microwave energy. Similarly, many other desirable cooling liquids readily absorb microwave energy.

Certain fluids such as silicone oils, some chlorofluorocarbons, and various hydrocarbon compounds do not absorb microwave energy and thus can be used to cool the outside of a plasma discharge tube. Unfortunately, these fluids are often environmentally undesirable, hazardous to handle, and expensive. In addition, using these fluids requires closed-loop heat exchangers which further increases the cost and complexity of the system.

It is therefore a principal object of this invention to utilize water or other desirable microwave absorbing fluids to cool a plasma discharge tube.

It is another object of this invention to utilize water or other desirable microwave absorbing fluids to cool a dielectric window which passes microwave energy to a chamber.

SUMMARY OF THE INVENTION

A principle discovery of the present invention is that a microwave electric field oriented in a particular direction can be efficiently coupled to a microwave plasma discharge tube having channels containing a microwave absorbing cooling liquid and surrounding the tube in a certain path. For example, a microwave electric field oriented parallel to a longitudinal axis extending through the center of the tube will efficiently couple to a plasma discharge tube having cooling channels encircling the tube in a helical path.

Another discovery of the present invention is that a microwave electric field oriented in a particular direction can be efficiently coupled to a dielectric window having one or more channels in contact with the window and containing a microwave absorbing cooling liquid. For example, a microwave electric field oriented parallel to the surface of the window will efficiently couple to a plasma discharge tube having cooling channels encircling the tube in a helical path.

Accordingly, the present invention features a fluid-cooled plasma applicator for microwave absorbing fluids comprising a plasma discharge tube formed from a material substantially transparent to microwave energy such as quartz, sapphire, or alumina. Tubes formed from sapphire are desirable for applications using fluorine based gasses. A cooling member surrounds the tube and defines a channel formed along an inner surface of the member and encircling an outer surface of the tube. The channel provides a conduit for transporting a microwave absorbing cooling fluid over the outer surface of the tube. A medium adjacent to the channel allows a microwave electric field to enter the tube and thus create and sustain a plasma therein while the fluid is flowing through the channel.

More particularly, the channel encircles the outer surface of the tube in a helical path. A microwave electric field oriented parallel to a longitudinal axis extending through the center of the tube enters the tube without being significantly attenuated by the fluid and thus allows a plasma to form and be sustained. The cooling member may be formed from polytetrafluorethylene which is chemically inert and microwave transparent. The channel within the member is connectable to a pump which forces the fluid over the outer surface of the tube. The fluid may be water which has high thermal conductivity and is convenient to use.

In another embodiment, a liquid-cooled plasma applicator comprises a plasma discharge tube formed from a material substantially transparent to microwave energy. An elongated cooling member having an outer surface in contact with the tube and an inner surface defining a channel for transporting a microwave absorbing cooling liquid surrounds the tube. The cooling member may be formed from polytetrafluorethylene, which is chemically inert and microwave transparent, or from high-thermal conductivity material which can be microwave transparent or reflecting. The outer surface of the member can be thermally bonded to the tube. A medium adjacent to the cooling member allows a microwave electric field to enter the tube and sustain a plasma in the tube while the liquid is flowing through the cooling member. The medium may be air.

More particularly, the cooling member may encircle the outer surface of the tube in a helical path. A microwave electric field oriented parallel to a longitudinal axis extending through the center of the tube enters the tube without being significantly attenuated by the fluid and thus allows a plasma to form and be sustained. The channel within the member is connectable to a pump which forces the fluid through the channel.

In yet another embodiment, a microwave or plasma system includes a source of microwave energy, a discharge tube substantially transparent to microwave energy and coupled to the source, and a cooling jacket circumferentialy positioned with respect to the tube and substantially transparent to microwave energy. The jacket defines a channel formed along an inner surface of the jacket in a helical path for transporting water over the outer surface of the tube. A medium adjacent to the channel allows a microwave electric field oriented parallel to a longitudinal axis extending through the center of the tube to enter the tube and sustain a plasma while the water is flowing through the channel. The system also includes a pump connected to a source of water and the channel which recirculates the water through the channel.

The present invention also features a fluid-cooled dielectric window for use in a microwave plasma system. A cooling member is in contact with an outer surface of the dielectric window. The window is formed of a material substantially transparent to microwave energy such as quartz, sapphire, or alumina. The cooling member defines a channel for transporting a microwave absorbing cooling fluid over the outer surface of the window and a medium adjacent to the channel. The medium allows a microwave electric field to enter through the window and sustain a plasma in the chamber while the fluid is flowing through the channel.

More specifically, the channel can form a spiral path over the outer surface of the window. An electric field oriented parallel to the surface of the window enters the window without being significantly attenuated by the fluid and thus allows a plasma to form and be sustained. The cooling member can be formed from polytetrafluorethylene which is chemically inert and microwave transparent. The channel within the member is connectable to a pump which forces the fluid over the outer surface of the window. The fluid may be water.

In another embodiment, an elongated cooling member has an outer surface in contact with the dielectric window and an inner surface defining a channel for transporting a microwave or RF-absorbing cooling fluid. A medium adjacent to the cooling member allows an electric field to pass through the window to create and sustain a plasma while a microwave absorbing cooling fluid is flowing through the channel. The cooling member may be formed from high-thermal conductivity material and the outer surface of the member may be thermally bonded to the tube.

More specifically, the outer surface of the channel may form a spiral path over the window. A microwave electric field oriented parallel to the surface of the window will enter the tube without being significantly attenuated by the fluid and thus will allow a plasma to form and be sustained.

In yet another embodiment, a plasma applicator includes a chamber having a dielectric window. A cooling member defines a channel having a spiral path for transporting a microwave absorbing cooling liquid over the outer surface of the window. A medium adjacent to the channel allows a microwave electric field oriented parallel to the surface of the window to pass through the window and sustain a plasma while a microwave absorbing cooling liquid is flowing through the channel. A pump connects to a source of liquid and to the channel recirculates the liquid through the channel.

Although the invention specifies microwave energy as the source for creating the plasma discharge, it is noted that the principles of the invention apply to the use of radio frequency (RF) energy sources as well. Also, although the invention specifies the use of microwave absorbing cooling liquids, it is noted that systems incorporating the invention can utilize non-absorbing cooling liquids as well.

BRIEF DESCRIPTION OF THE DRAWINGS

The foregoing and other objects, features and advantages of the invention will become apparent from the following more particular description of preferred embodiments of the invention, as illustrated in the accompanying drawings. The drawings are not necessarily to scale, emphasis instead being placed on illustrating the principles of the present invention.

DETAILED DESCRIPTION

Figure 1:
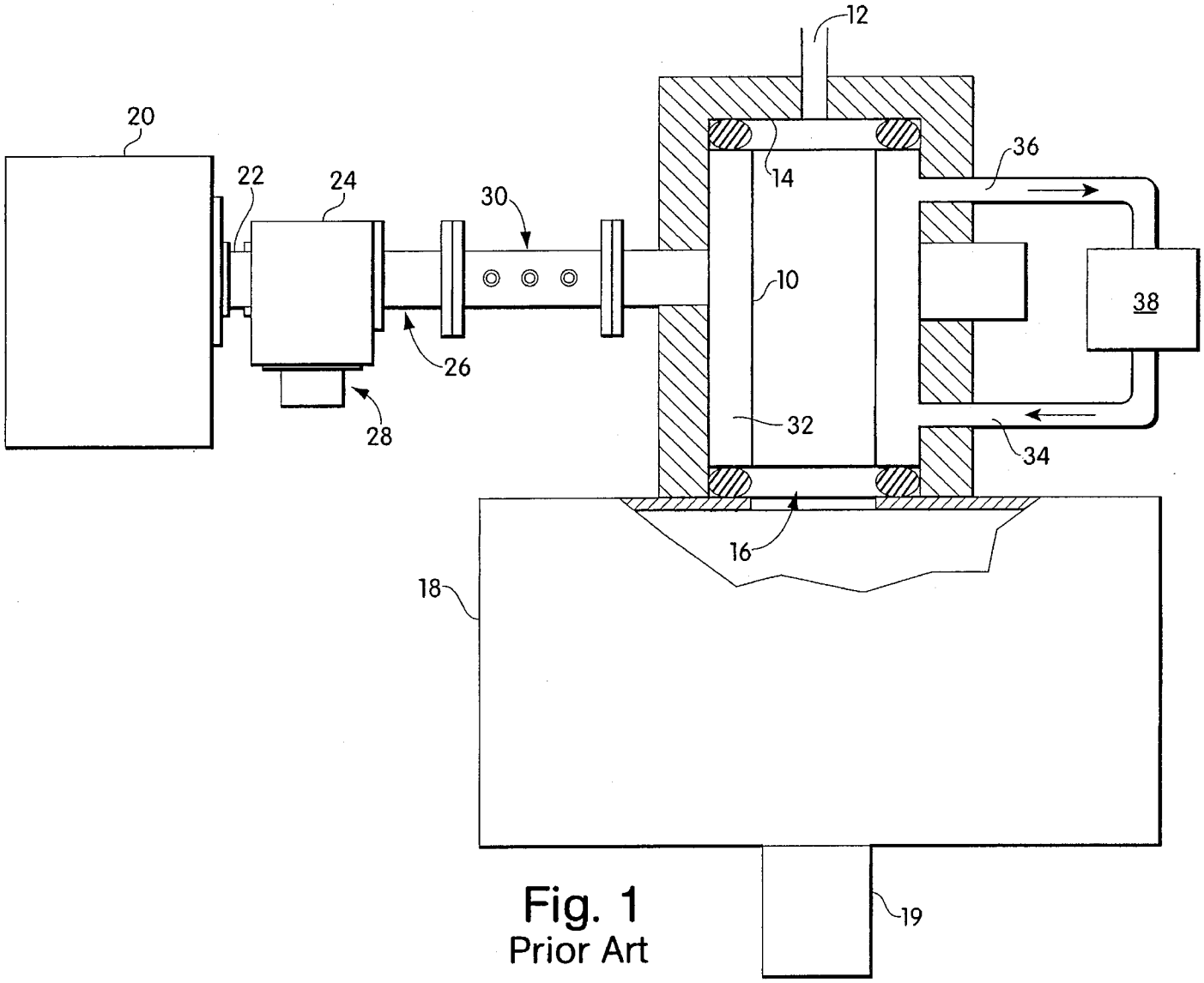
Fig. 1 Prior Art
FIG. 1 is a cross-sectional view of a prior art liquid-cooled microwave plasma applicator.

FIG. 1 is a cross-sectional view of a prior art liquid-cooled microwave plasma applicator. The applicator includes a dielectric discharge tube 10. The tube is made of material which is substantially transparent to microwave energy and which has suitable mechanical, thermal, and chemical properties for plasma processing. Typical materials include quartz, sapphire, and alumina. A gas inlet 12 positioned at a top of the tube 14 allows process gasses to be introduced into the tube. A bottom of the tube 16 is coupled to a vacuum chamber 18. A vacuum pump 19 is used to evacuate the chamber. During processing, reactive gas species generated in the tube flow downstream into the chamber.

A magnetron 20 generates the microwave energy required to create and sustain a plasma in the tube. An output 22 of the magnetron is coupled to a circulator 24 which allows the microwave energy to pass unrestricted to a waveguide 26 which is coupled to the tube. The waveguide transports the energy to the tube. The circulator directs the microwave energy reflected by the tube to a dummy load 28 so as not to damage the magnetron. A tuner 30 minimizes the reflected energy by perturbing the electromagnetic field in the waveguide.

A cooling jacket 32 with an inlet 34 and an outlet 36 surrounds the tube. A pump 38 coupled to the jacket forces cooling liquid into the inlet, through the jacket, and through the outlet back to the pump. The liquid directly contacts the entire outer surface of the tube. Thus, the microwave energy in the waveguide must travel through the liquid to reach the tube. If the liquid significantly absorbs microwave energy, the energy in the waveguide does not sufficiently couple to the tube to form and sustain a plasma.

Thus, only liquids which do not significantly absorb microwave energy are used in a conventional liquid-cooled microwave plasma applicator. Examples of such liquids include silicone oils, certain chlorofluorocarbons, and various hydrocarbon compounds. Unfortunately, such fluids are both environmentally undesirable and expensive. Many such fluids are also hazardous to workers and require complex handling procedures. In addition, most of these liquids require the use of closed-loop heat exchangers which significantly increase the system cost and complexity. Furthermore, if the tube were to rupture, these fluids would contaminate the processing equipment.

Figure 2:
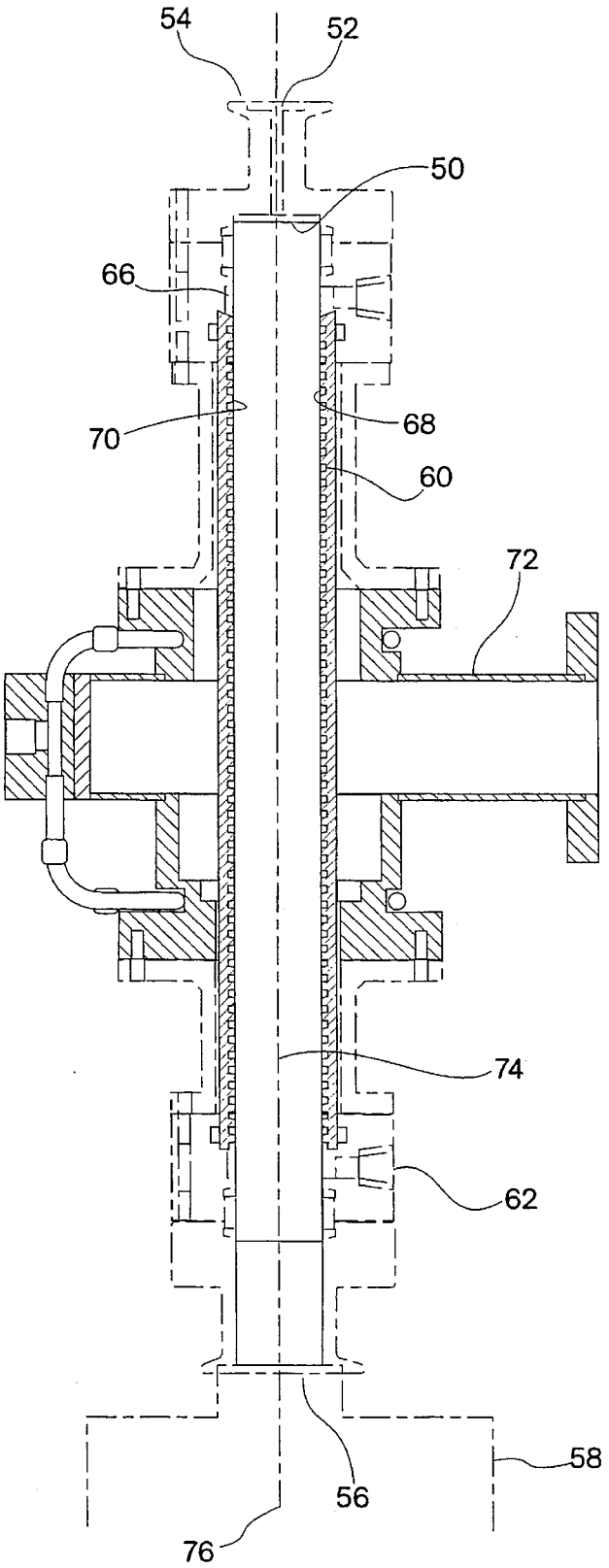
FIG. 2 is a cross-sectional view of a fluid cooled microwave plasma applicator for microwave absorbing fluids.

FIG. 2 is a cross-sectional view of a fluid cooled microwave plasma applicator for microwave absorbing fluids which incorporates the principles of this invention. The applicator is similar to the prior art. It includes a dielectric discharge tube 50 made of a material which is substantially transparent to microwave energy and which has suitable mechanical, thermal, and chemical properties for plasma processing. Such materials include quartz, sapphire, and alumina. Tubes formed from sapphire are desirable for applications using fluorine based gasses. A gas inlet 52 positioned at a top of the tube 54 allows process gasses to be introduced into the tube. A bottom of the tube 56 is coupled to a vacuum chamber 58. Reactive gas species generated in the tube flow downstream into the chamber.

A cooling jacket 60 with an inlet 62 and an outlet 64 surrounds an outer surface 66 of the tube. The jacket is formed of a material which is substantially transparent to microwave energy. An example of such a material is polytetrafluorethylene. The jacket contains a channel 68 formed along an inner surface 70 of the jacket that encircles the outer surface of the tube. The channel provides a conduit for transporting a microwave absorbing cooling fluid directly over the outer surface of the tube. The fluid can be water which is convenient because it readily available, has high thermal conductivity, and is chemically inert.

The channel forces the cooling fluid to take a particular path around the outer surface of the discharge tube. The path is chosen to maximize the area of the discharge tube exposed to the cooling fluid. The path, however, leaves sufficient space to allow a microwave electric field with a certain orientation to enter the tube and form and sustains the plasma discharge. In one embodiment, the channel encircles the outer surface of the tube in a helical path leaving a small separation between the loops of the path.

A waveguide 72 carries the microwave energy necessary to create and sustain a plasma in the tube from the magnetron (not shown) to the tube 50. In one embodiment, the microwave electric field is oriented parallel to a longitudinal axis 74 extending through a center of the tube 76. This orientation allows microwave energy to readily penetrate the tube between the loops of the helical channels without being significantly attenuated by the fluid and thus will allow a plasma to form and be sustained.

Although microwave energy is specified as the source for creating the plasma discharge, it is noted that the principles of the invention apply to the use of radio frequency (RF) energy sources. Also, although the use of microwave absorbing cooling liquids is specified, it is noted that systems incorporating the invention can utilize non-absorbing cooling liquids.

Figure 3:
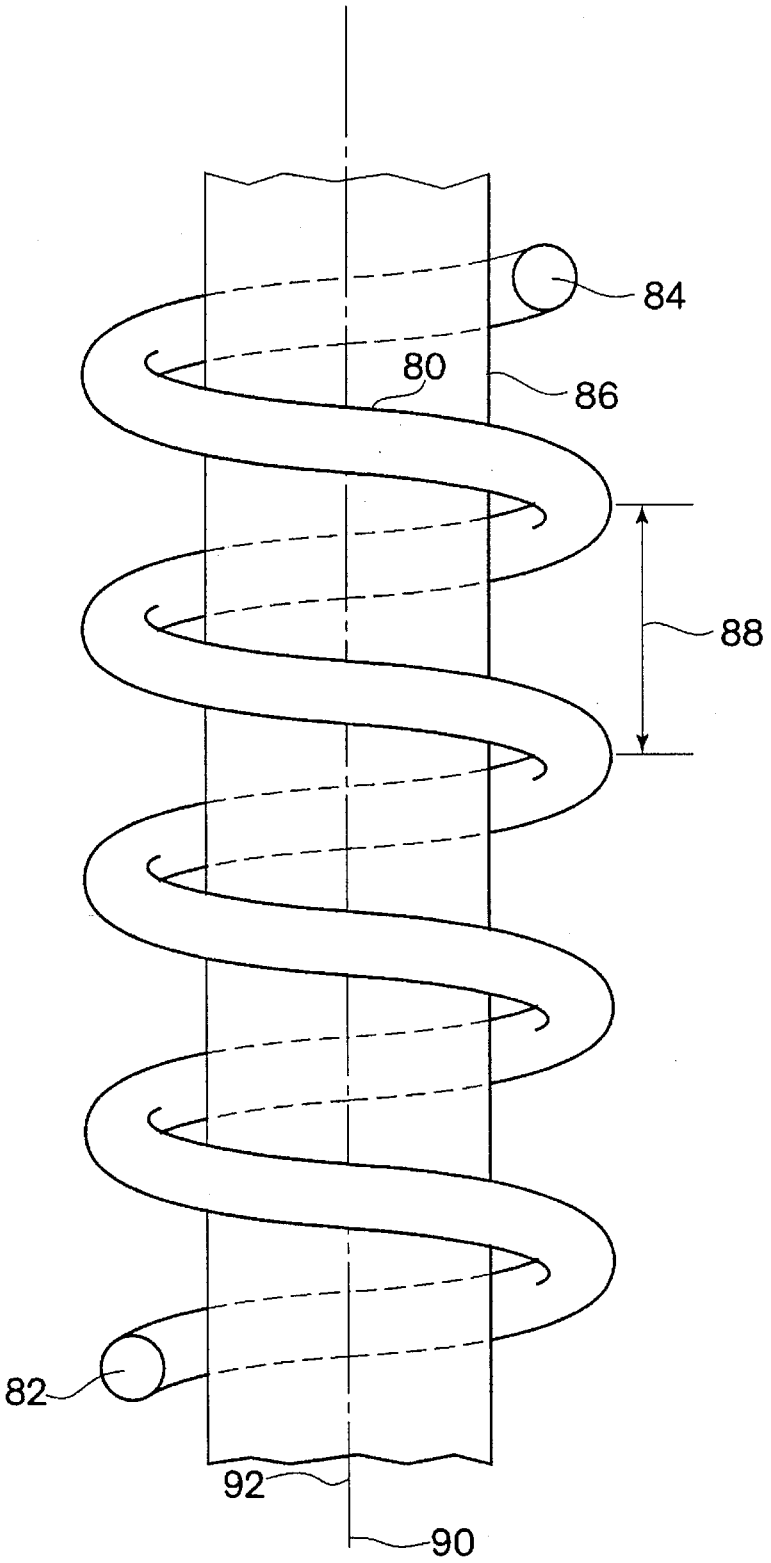
FIG. 3 is a cross-sectional view of an alternative embodiment of the cooling jacket of the fluid cooled microwave plasma applicator for microwave absorbing fluids.

FIG. 3 is a cross-sectional view of an alternative embodiment of the cooling jacket. A cooling tube 80 with an inlet 82 and an outlet 84 is wrapped around the discharge tube. The cooling tube preferably encircles the outer surface of the discharge tube 86 in a helical path leaving a small separation between the loops of the path 88. The microwave electric field is oriented parallel to a longitudinal axis 90 extending through a center of the tube 92. This orientation allows microwave energy to readily penetrate the tube between the loops of the helical channels without being significantly attenuated by the fluid and thus allows a plasma to form and be sustained.

The cooling tube can be either metallic or non-metallic and is thermally bonded to the outer surface of the discharge tube. This embodiment is useful for situations where direct contact between the fluid and the outer surface of the tube is undesirable.

Figure 4:
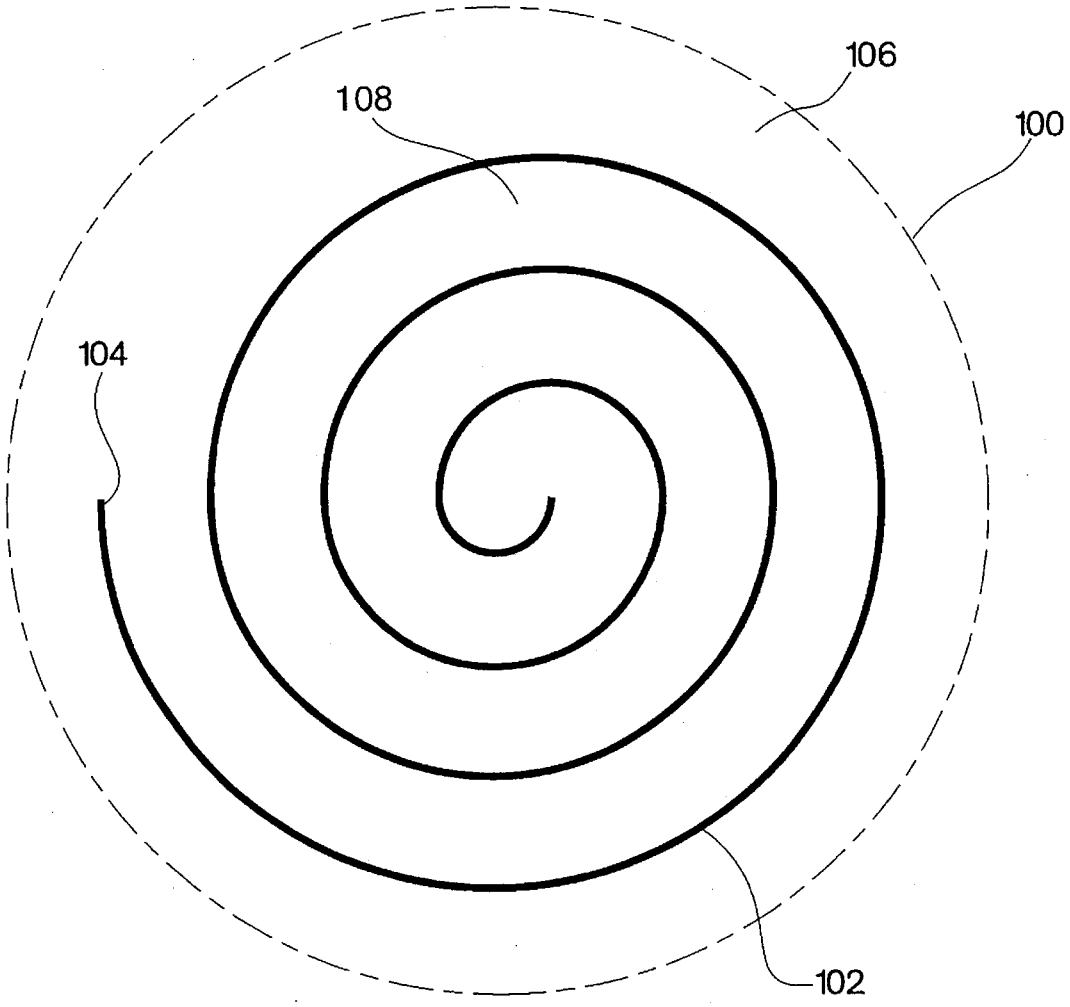
FIG. 4 is a top view of a fluid-cooled dielectric window for a microwave plasma system.

FIG. 4 is a top view of fluid-cooled dielectric window for a microwave plasma system which represents another aspect of the present invention. A dielectric window 100 substantially transparent to microwave energy allows microwave energy to enter into a chamber (not shown). The window is typically formed of quartz, sapphire, or alumina.

A cooling member 102 defines a channel 104 for transporting a microwave absorbing cooling fluid over an outer surface 106 of window 100 and a medium 108 adjacent to the channel. The cooling member may be a cooling jacket surrounding the window. The medium is substantially transparent to microwave energy. The channel is formed in a certain path so as to allow a microwave electric field of a certain orientation to enter the window and create and sustain a plasma in the chamber while the fluid is flowing through the channel. The channel within the member is coupled to a pump (not shown) which forces the fluid over the outer surface of the window. The fluid can be water which has high thermal conductivity and is convenient to use.

In one embodiment, the cooling jacket defines a channel having a spiral path for transporting a microwave absorbing cooling liquid over the outer surface of the window. The jacket can be formed from polytetrafluorethylene which is chemically inert. A medium adjacent to the channel between the spiral path is substantially transparent to microwave energy. A spiral pattern is desirable because it minimizes coupling of microwave energy in the radial direction. Thus, an electric field oriented parallel to the surface of the window passes through the window substantially unattenuated and can create and sustain a plasma while a microwave absorbing cooling liquid is flowing through the channel.

Alternatively, the cooling member may be an elongated cooling member having an outer surface in contact with the window and an inner surface defining a channel for transporting a microwave or RF-absorbing cooling fluid. The elongated member is positioned in contact with the window. A medium adjacent to the cooling member allows an electric field to pass through the window to create and sustain a plasma while a microwave absorbing cooling fluid is flowing through the channel. The medium may be air. The cooling member may be formed from high-thermal conductivity material and the outer surface of the member can be thermally bonded to the tube.

Equivalents

While the invention has been particularly shown and described with reference to specific preferred embodiments, it should be understood by those skilled in the art that various changes in form and detail may be made therein without departing from the spirit and scope of the invention as defined by the appended claims. For example, although a particular orientation for a microwave electric field and a particular path for a microwave absorbing cooling liquid is described in reference to a fluid-cooled plasma applicator and a fluid-cooled dielectric window, it is noted that other electric field orientations and liquid paths can be used without departing from the spirit and scope of the invention.

What is claimed is:

1. In a plasma system which includes a plasma chamber and a microwave generator that generates an electric field which sustains a plasma in the plasma chamber, a fluid-cooled dielectric window comprising:

a dielectric window;

a cooling member coupled to a source of microwave or RF absorbing cooling fluid and in contact with an outer surface of the window defining a spiral channel for transporting the fluid over the outer surface of the window;

a medium adjacent to the channel which allows the electric field from the microwave generator to enter through the window and sustain the plasma in the chamber while the fluid is flowing through the channel; and bonding material for thermally bonding the cooling member to the outer surface of the dielectric window.

2. The plasma system of claim 1 wherein the channel is connected to a pump and the fluid is forced over the outer surface of the window by the pump.

3. The plasma system of claim 1 wherein the electric field is oriented parallel to the outer surface of the window.

4. The plasma of claim 1 wherein the fluid is water.

5. The plasma system of claim 1 wherein the cooling member is comprised of polytetrafluorethylene.

6. The plasma system of claim 1 wherein the window is comprised of sapphire.

7. The plasma system of claim 1 wherein the window is comprised of one of quartz and alumina.

8. A plasma system comprising:

a microwave generator that generates an electric field;

a chamber for sustaining a plasma, the chamber having a dielectric window with an outer surface;

a pump;

a source of microwave or RF absorbing cooling fluid coupled to the pump; and a cooling member in contact with the outer surface of the window defining (i) a channel operatively connected to the pump having a spiral path for transporting the microwave or RF absorbing cooling fluid over the outer surface of the window, and (ii) a medium adjacent to the channel which allows the electric field oriented parallel to the surface of the window to pass through the window and sustain the plasma while the microwave absorbing cooling fluid is flowing through the channel.

9. The plasma system of claim 8 wherein the cooling member is comprised of polytetrafluorethylene.

10. The plasma system of claim 8 wherein the fluid is forced through the member by the pump.

11. The plasma system of claim 8 wherein the medium is air.

12. In a plasma system which includes a plasma chamber and a microwave generator that generates an electric field which sustains a plasma in the plasma chamber, a fluid-cooled dielectric window comprising:

a dielectric window;

an elongated cooling member coupled to a source of microwave or RF absorbing cooling fluid and having an outer surface in contact with the window and an inner surface defining a spiral channel for transporting the fluid;

a medium adjacent to the cooling member which allows the electric field to pass through the window and sustain the plasma while a microwave absorbing cooling fluid is flowing through the channel; and bonding material for thermally bonding the cooling member to the outer surface of the dielectric window.

13. The plasma system of claim 12 wherein the cooling member comprises high-thermal conductivity material.

14. The plasma system of claim 12 wherein the fluid is water.

15. The plasma system of claim 12 wherein the cooling member is comprised of polytetrafluorethylene.

16. The plasma system of claim 12 wherein the window is comprised of sapphire.

17. The plasma system of claim 12 wherein the channel is connected to a pump and the fluid is forced over the outer surface of the window by the pump.

18. The plasma system of claim 12 wherein the electric field is oriented parallel to the outer surface of the window.

19. The plasma system of claim 12 wherein the channel defines a spiral path.

* * * * *